United States Patent [19]

Mase et al.

[11] 4,359,034

[45] Nov. 16, 1982

[54] EXHAUST GAS RECIRCULATION CONTROL SYSTEM

[75] Inventors: Yasushi Mase; Toshikazu Okamura, both of Tokyo, Japan

[73] Assignee: Nissan Motor Company, Limited, Yokohama, Japan

[21] Appl. No.: 243,425

[22] Filed: Mar. 13, 1981

Related U.S. Application Data

[62] Division of Ser. No. 45,410, Jun. 4, 1979, Pat. No. 4,267,809.

[30] Foreign Application Priority Data

Jul. 5, 1978 [JP] Japan ..... 53-80944

[51] Int. Cl.[3] ..... F02M 25/06

[52] U.S. Cl. ..... 123/571; 123/568

[58] Field of Search ..... 123/568, 509, 571

[56] References Cited

U.S. PATENT DOCUMENTS 3,941,105 3/1956 Yagi et al. .
4,031,871 6/1977 Hamanishi .
4,056,083 11/1977 Wakita .
4,090,482 5/1978 Yoshida .
4,267,809 5/1981 Mase et al. .

FOREIGN PATENT DOCUMENTS 53-64122 6/1978 Japan ..... 123/568

*Primary Examiner*—Wendell E. Burns

*Attorney, Agent, or Firm*—Schwartz, Jeffery, Schwaab, Mack, Blumenthal & Koch

[57] ABSTRACT

An exhaust gas recirculation control system for an internal combustion engine for removing nitrogen oxides (NOx) in exhaust gases comprises a positive pressure delay valve in a negative pressure passage for introducing intake negative pressure in the proximity of a throttle valve of a carburetor into an exhaust gas recirculation control valve to maintain the negative pressure therein during an acceleration, thereby effecting the exhaust gas recirculation even when accelerating to purify the nitrogen oxides in the exhaust gas.

The exhaust gas recirculation control system further comprises a positive pressure delay valve in an advance negative pressure passage for introducing the intake negative pressure in the vicinity of the throttle valve of a carburetor into a distributor and synchronized with the above positive pressure delay valve to maintain the distributor advanced, thereby keeping a good combustion of fuel mixture.

3 Claims, 3 Drawing Figures

EXHAUST GAS RECIRCULATION CONTROL SYSTEM

This is a division, of application Ser. No. 045,410, filed June 4, 1979 now U.S. Pat. No. 4,267,809 of May 19, 1981.

BACKGROUND OF THE INVENTION

1. Field of the Invention

This invention relates to an exhaust gas recirculation control system used for removing nitrogen oxides (NOx) in exhaust gases discharged from internal combustion engines.

2. Description of the Priot Art

In conventional exhaust gas recirculation control systems hitherto used, an exhaust gas recirculation control valve for controlling the recirculation gas flow is generally operated by intake negative pressure introduced thereinto from a throttle valve of a carburetor through a negative pressure passage including in its midway a negative pressure regulator which is operated by an exhaust gas pressure to regulate the intake negative pressure in order to maintain an optimum amount of the recirculation gas flow according to a condition of the engine operation.

With this arrangement of the prior art, however, the exhaust gas recirculation control valve is apt to close prematurely when the throttle valve is widely opened, for example, in accelerating the engine, so that the nitrogen oxides in the exhaust gases cannot be purified. Moreover, when the engine is accelerated, the nitrogen oxides in the exhaust gases are much more than those during normal travelling. Accordingly, it is necessary to increase the recirculation gas flow when accelerating. The control systems of the prior art are not sufficient to achieve a complete purification of the nitrogen oxides in the exhaust gases.

SUMMARY OF THE INVENTION

It is therefore an object of the invention to provide an improved exhaust gas recirculation control system which overcomes the above disadvantages in the prior art.

It is another object of the invention to provide an exhaust gas recirculation control system comprising a positive pressure delay valve in a negative pressure passage for introducing intake negative pressure in the proximity of a throttle valve of a carburetor into an exhaust gas recirculation control valve to maintain the negative pressure in the exhaust gas recirculation flow control valve during an acceleration, which would otherwise rise due to the intake negative pressure being raised by the acceleration, thereby enabling the exhaust gas recirculation to purify the nitrogen oxides in the exhaust gases.

It is a further object of the invention to provide an exhaust gas recirculation control system further comprising a positive pressure delay valve provided in an advance negative pressure passage for introducing the intake negative pressure in the proximity of the throttle valve of the carburetor into a distibutor, and synchronized with the above positive pressure delay valve to maintain the distributor advanced, thereby maintaining good combustion of the fuel mixture.

The invention will be more fully understood by referring to the following detailed specification and claims taken in connection with the appended drawings.

DETAILED DESCRIPTION OF THE PREFERRED EMBODIMENTS

Figure 1:
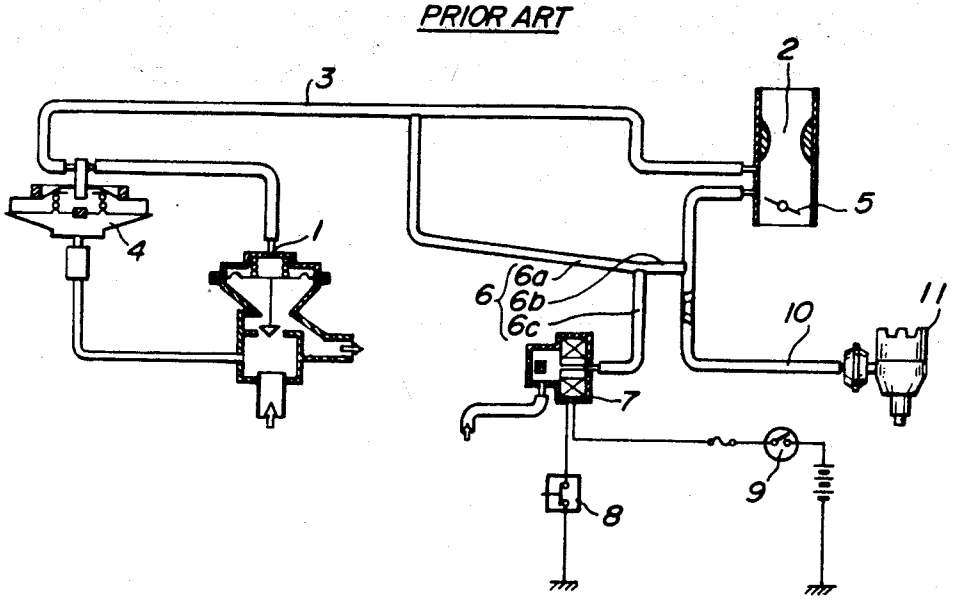
FIG. 1 PRIOR ART
FIG. 1 illustrates an exhaust gas recirculation control system in the prior art.

FIG. 1 illustrates an exhaust gas recirculation control system of the prior art, including an exhaust gas recirculation control valve 1 for controlling the recirculation gas flow adapted to be actuated by intake negative pressure introduced thereinto from the proximity of a throttle valve 5 of a carburetor 2 through a negative pressure passage 3 including in its midway a negative pressure regulator 4 which is operated by exhaust gas pressure to regulate the intake negative pressure in order to keep a suitable amount of the recirculation gas flow according to a condition of the engine operation.

With this arrangement, however, the exhaust gas recirculation control valve 1 tends to close prematurely when the throttle valve is widely opened to raise the intake negative pressure therein, for example, when accelerating, with the result that the purification of the nitrogen oxides cannot be effected. In addition, when the engine is accelerated, the nitrogen oxides (NOx) in the exhaust gases are much more than those during a normal travelling, because great amount of fuel and air mixture is fed into a combustion chamber of the engine by a completely depressed accelerator pedal to increase the intake mixture per one stroke which would in turn increase the calorific value during combustion of the mixture which would raise the temperature in the combustion chamber to increase the nitrogen oxides (NOx) due to reaction with the air.

Accordingly, it is absolutely necessary to increase the recirculation gas flow when accelerating in order to improve the purification of the exhaust gases containing the nitrogen oxides (NOx). The control system of the prior art shown in FIG. 1 is not sufficient to overcome this problem.

Referring to FIG. 1, air passages 6, an electromagnetic valve 7 and a top gear switch 8 are provided to stop the exhaust gas recirculation when travelling at a high speed. The top gear switch 8, which senses the high speed drive, actuates the electromagnetic valve 7 to allow the atmosphere air from an air passage **6*c* to flow into air passages 6*a* and 6*b* and hence to an advance negative pressure passage 10 communicating the negative pressure passage 3 with a distributor 11 so that the pressure in these passages will rise to close the exhaust gas recirculation control valve 1. A reference numeral 9 illustrates an ignition switch. With this arrangement, the air is fed to both the exhaust gas recirculation control valve 1 and a distributor 11** simultaneously, because it is not necessary to advance the distributor owing to an ignition quality of the mixture improved by the decrease of the unburned components therein resulting from the decrease of the recirculation gas.

Figure 2:
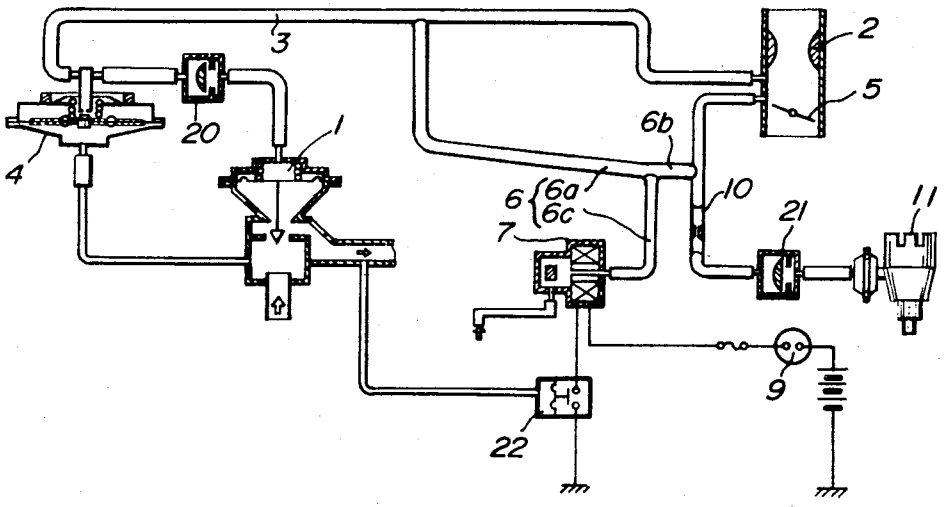
FIG. 2 illustrates one embodiment of an exhaust gas recirculation control system according to the invention.

Referring to FIG. 2 illustrating one embodiment of the exhaust gas recirculation control system according to the invention, a negative pressure passage 3 between a negative pressure regulator 4 and an exhaust gas recirculation control valve 1 includes a positive pressure delay valve 20. In the embodiment shown in FIG. 2, the negative pressure regulator 4 is provided upstream of the positive pressure delay valve. However, the negative pressure regulator 4 may be provided downstream of the positive pressure delay valve as the case may be. A positive pressure delay valve 21 similar in construction to the valve 20 is provided in an advance negative pressure passage 10 at a location near to a distributor 11 and remote from air passages 6 connected to the advance negative pressure passage 10.

Figure 3:
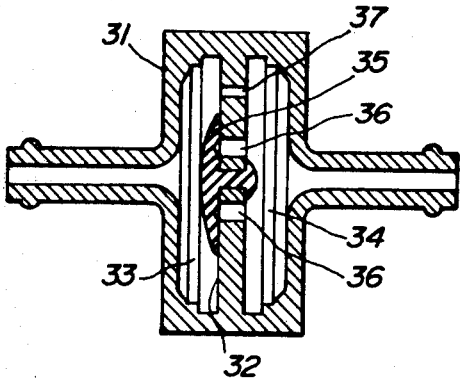
FIG. 3 is a sectional view of a positive pressure delay valve to be used in the system according to the invention.

FIG. 3 shows a construction of the positive pressure delay valves 20 and 21 in detail. As the valves 20 and 21 are substantially the same in construction, only one of the valves will be explained herein. A casing 31 comprises a partition 32 provided therein to divide the interior of the casing into two chambers 33 and 34. The partition 32 is provided in its center with a rubber valve 35 in the form of a mushroom secured thereto to close orifices 36 formed in the partition. The partition is further formed at a location radially outside of the rubber valve 35 with a small orifice 37 which serves to equalize the pressures in the chambers 34 and 33 when a certain period of time has elapsed. A sintered metal plug may be fitted in the orifice 37 to obtain the most suitable flow resistance therethrough for this purpose. In this case, it is preferable to provide a larger diameter orifice 37 or a plurality of small orifices 37. The rubber valve 35 opens the orifices 36 when the negative pressure in the chamber 33 is lower than that in the chamber 34 and closes the orifices 36 when the negative pressure in the chamber 33 is higher. According to the invention, the chamber 33 is communicated to a passage to a carburetor 2 and the chamber 34 is communicated to a passage to an exhaust gas recirculation control valve 1 or a distributor.

A negative pressure valve 22 senses a deceleration to operate an electromagnetic valve 7 for introducing atmospheric air into the air passages 6 because of less NOx during the deceleration which does not need the exhaust gas recirculation. The negative pressure valve 22 is substantially identical in construction with the top gear switch 8 in FIG. 1. Other components and arrangements are similar to the system of the prior art shown in FIG. 1, which will not be described in further detail.

The operation of the system according to the invention will be explained hereinafter. When a driver fully treads on an accelerator pedal to open a throttle valve 5 of a carburetor 2 completely for an acceleration, the intake negative pressure and hence the negative pressure in the negative pressure passage could be lowered. However, the negative pressure passage 3 between the positive pressure delay valve 20 and the exhaust gas recirculation control valve 1 will contain a negative pressure therein because of the positive pressure delay valve 20. In other words, the pressure in the chamber 33 of the delay valve 20 is substantially at the atmospheric pressure, while the pressure in the chamber 34 is at a negative pressure, so that the rubber valve 35 is urged by the pressure difference in a direction to close the orifices 36 thereby keeping the negative pressure in the chamber 34 which maintains the exhaust gas recirculation control valve 1 opened. Because of the small orifice 37, the pressures in the chambers 34 and 33 are equalized when a short period of time has elapsed. The positive pressure delay valve 21 provided in the advance negative pressure passage 10 also operates in the same manner to keep the distributor advanced.

According to the invention, as above described, even when accelerating, the exhaust gas recirculation is effected to purify NOx and simultaneously accomplishes correct ignition times to more improve the purification of the exhaust gas.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. An exhaust gas recirculation control system for an internal combustion engine having an intake passage and an exhaust passage, comprising:

an exhaust gas recirculation passage connected between said intake passage and said exhaust passage of the engine;

a control valve for controlling the exhaust gas recirculation rate flowing through the exhaust gas recirculation passage, the valve being opened in response to intake vacuum from said intake passage;

a vacuum passage connected between the intake passage and the valve;

a delay valve disposed in the vacuum passage, the delay valve having a one-way check valve oriented to allow fluid flow only toward said intake passage, and an orifice positioned to equalize the pressure on opposite sides of said check valve when said check valve is closed;

an air passage connected to the vacuum passage between the intake passage and the delay valve;

an electromagnetic valve disposed in the air passage; and means to open said electromagnetic valve to introduce air into the vacuum passage during deceleration of the engine.

2. An exhaust gas recirculation control system as set forth in claim 1, wherein a negative pressure regulator is provided upstream of said delay valve in the vacuum passage.

3. An exhaust gas recirculation control system as set forth in claim 1, wherein said opening means comprises a negative pressure valve operated switch connected to said exhaust gas recirculation passage.

* * * * *